US005984001A

United States Patent [19]

Welkey

[11] Patent Number: 5,984,001

[45] Date of Patent: Nov. 16, 1999

[54] TAPERED SPLIT RING SHELL CLOSURE

[75] Inventor: Joseph Welkey, Houston, Tex.

[73] Assignee: Brown Fintube Company, Houston, Tex.

[21] Appl. No.: 08/937,562

[22] Filed: Sep. 25, 1997

[51] Int. Cl.[6] ..... F28F 9/12

[52] U.S. Cl. ..... 165/158; 165/178; 285/337; 285/374

[58] Field of Search ..... 165/158, 178; 285/337, 374

[56] References Cited

U.S. PATENT DOCUMENTS

| | | | |
|---|---|---|---|
| 2,296,710 | 9/1942 | Fischer | 165/158 X |
| 2,857,142 | 10/1958 | Gertzon | 165/158 X |
| 3,221,808 | 12/1965 | Pyle, Jr. | 165/158 X |
| 3,381,983 | 5/1968 | Hanes | 285/374 X |
| 3,712,648 | 1/1973 | Clifford | 285/374 X |
| 3,833,055 | 9/1974 | Munz et al. | 165/158 X |
| 3,861,722 | 1/1975 | Kenyon | 285/337 |
| 4,116,478 | 9/1978 | Yamaji et al. | 285/374 X |
| 4,119,141 | 10/1978 | Thut et al. | 165/158 X |
| 4,846,262 | 7/1989 | Lawrance et al. | 165/158 X |
| 5,297,824 | 3/1994 | Imhof et al. | 285/374 X |

FOREIGN PATENT DOCUMENTS

| | | | |
|---|---|---|---|
| 1340676 | 9/1963 | France | 285/374 |

*Primary Examiner*—Leonard R Leo
*Attorney, Agent, or Firm*—The Matthews Firm

[57] ABSTRACT

A heat exchanger shell closure utilizing a tapered split ring is disclosed. The split ring of the invention has a tapered inner surface which fits into a corresponding tapered groove in a tube sheet barrel. A backup flange fits over the split ring, forcing the split ring into the deepest and forwardmost part of the groove, thereby preventing longitudinal movement of the split ring and the resulting movement and wear of a sealing ring which is held in place by the split ring as the heat exchanger undergoes load variations.

22 Claims, 4 Drawing Sheets

TAPERED SPLIT RING SHELL CLOSURE

FIELD OF THE INVENTION

This invention relates generally to heat exchangers and more particularly to an improved shell closure for use in multi-tube hairpin heat exchangers to maintain and seal the connection between the tube sheet barrel and the shell which surrounds the tubes.

BACKGROUND OF THE INVENTION

It has long been known that heat can be transferred from one fluid to another by means of mechanical heat exchanging devices. These devices place the fluids in thermal contact, while maintaining physical separation so that the fluids are not mixed. These heat exchanger devices often utilize one or more tubes which are surrounded by an enclosure which is usually referred to as a shell. One fluid is circulated through the tubes while the other fluid is circulated through the shell, where it is in contact with the outer surface of the tubes. Energy from the hotter of the two fluids is thereby allowed to pass through the walls of the tubes to the lower temperature fluid.

One particular type of heat exchanger called a hairpin heat exchanger 1 (see FIGS. 1*a*, 1*b*) typically utilizes a number of long straight tubes 2 (the "tubes") enclosed within a long shell enclosure 3 (the "shell pipe"). Each of the tubes is typically straight except for a U-shaped bend halfway along its length. The shell pipe typically comprises two straight, large-diameter tubes 5 connected at one end by a return end bonnet closure 6. Fluids flowing through the tubes and shell pipe thus flow along the length of their straight portions, then make a hairpin turn before returning along the length of their second straight portions. This characteristic shape gives hairpin heat exchangers their name.

At the non-U-shaped ends of the tubes and shell (hereinafter referred to simply as the ends), there are inlets and outlets which allow the fluids to flow into, through, and out of the tubes and shell. The shell usually has inlet 10 and outlet 11 ports which face perpendicularly away from the heat exchanger. The tubes 2, on the other hand, normally terminate at a bulkhead which is part of the tube sheet barrel 29. The open ends of the tubes face away from the shell pipe in a direction parallel to their straight portions 5. The end of the tube sheet barrel facing this direction will be referred to as the tube closure end (which is the end on the right side of FIG. 2). The open ends of the tubes are enclosed within a tube closure 15 which is essentially a manifold to the tubes.

In order to allow inspection and cleaning, hairpin heat exchangers normally have closures 16 on the ends of the shell pipe which can be removed to expose the tubes within. These closures must, of course, be designed to withstand the pressure of the fluid inside the shell without failing and leaking this fluid. The invention is directed to an improved end closure which reduces the wear on seals, withstands higher fluid pressures than prior art closures without failing, reduces movement of components in the closure, reduces the amount of materials required to fabricate the closure, increases the ease of assembling and disassembling the closure and increases safety for people working on the closure.

The prior art end shell closure is shown in FIG. 2. The shell 21 has a shell closure flange 23 at its end. The tube sheet barrel 29 has an outer diameter which is slightly less than the inner diameter of shell 21 at the closure flange 23 so that the end of the tube sheet barrel fits within the shell. The end of the tube sheet barrel facing the shell will be referred to as the shell closure end (which is the end on the left side of FIG. 2). The tube sheet barrel 29 has a groove 30 on its outer surface into which split ring 27 fits. A compression flange 25 fits over the tube sheet barrel 29 so that it is between shell closure flange 23 and split ring 27. A shell sealing ring 32 is placed around the tube sheet barrel 29 so that it is between shell closure flange 23 and compression ring 25. A bolt 24 fits through apertures in the shell closure flange 23, compression flange 25 and split ring 27. Nuts 26 are threaded onto bolt 24 and tightened so that shell closure flange 23 and split ring 27 are urged toward each other. As a result, shell sealing ring 32 is compressed between compression flange 25 and shell closure flange 23. Shell closure flange 23 typically has a beveled edge 22 which causes shell sealing ring 32 to be compressed against tube sheet barrel 29 as well.

The prior art shell closures suffers from a number of problems. Because groove 30 must be wide enough to allow split ring 27 to fit within the groove 30, split ring 27 is allowed to move to some extent along the length of the tube sheet barrel 29. This in turn allows compression flange 25 and shell sealing ring 32 to move along the length of the tube sheet barrel 29. Because the loads (fluid pressures) in heat exchangers which tend to force shell 21 and tube sheet barrel 29 apart are normally cyclic, there is normally some movement of sealing ring 32, compression flange 25 and split ring 27 during the operation of prior art heat exchangers. This movement causes wear on the shell sealing ring 39 which will fail more quickly than it would in the absence of such movement. Higher loads cause greater movement, so the load of the heat exchanger is limited because of this movement and the resulting increases in the wear and failure of the shell sealing ring.

Additionally, because ASME regulations require that split rings have a minimum width to meet safety standards, the split ring is typically very heavy (more than a hundred pounds per half of the ring). Assembly of the closure can therefore be awkward and it may require several people to assemble a closure which has such a prior art split ring. If one of these split ring halves is dropped, it can be very dangerous. Because the split ring is required by these safety regulations to have a minimum width, the tubes and other closure components have to be manufactured with their length increased by the width of the split ring. If the tubes or components utilize expensive materials, such as titanium, the increased cost of these components can significantly increase the overall cost of the heat exchanger.

SUMMARY OF THE INVENTION

The invention does not use the large split ring and constant-depth groove of prior art devices, but instead uses a much smaller split ring with a tapered surface and a tapered groove. When the split ring is placed in the groove and inward radial pressure applied, the taper causes the split ring to be held tightly against the forward wall of the groove. This radial pressure is applied by a backup flange which is positioned radially outward from the split ring. The backup flange also extends behind the portion of the split ring which extends outward from the groove, above the surface of the tube sheet barrel, so that when the backup flange is moved toward the shell closure flange, it directly contacts the back of the split ring and forces it forward, into contact with the front wall of the groove.

Thus, the large split ring of prior art devices is replaced in the invention by a solid backup flange and a much smaller split ring. Because the backup flange, rather than the split ring, bears the forces of the connection to the shell closure flange, the split ring is not constrained by safety regulations to have the minimum width (and corresponding weight) of prior art split rings. The backup flange is also allowed to be thinner than the prior art split ring because it is a single piece. The closure of the invention therefore uses less materials than prior art closures. The inventive closure is lighter and therefore easier and safer to work with than the prior art because of the reduced materials.

Because the sealing ring of the prior art abuts a compression flange which abuts the split ring, movement of the split ring results in movement of the sealing ring. By eliminating the longitudinal movement of the prior art split ring, the inventive design eliminates movement and corresponding wear of the sealing ring, thereby reducing failures of the sealing ring and increasing the maximum load which can be borne by the closure. By eliminating the possibility that the two halves of the split ring can move independently, the invention also makes it possible to eliminate the compression flange which is required in the prior art to even out the compressive forces on the sealing ring. By eliminating the compression flange, the invention further reduces the weight of the closure.

DETAILED DESCRIPTION OF THE PREFERRED EMBODIMENT

Figure 1A:
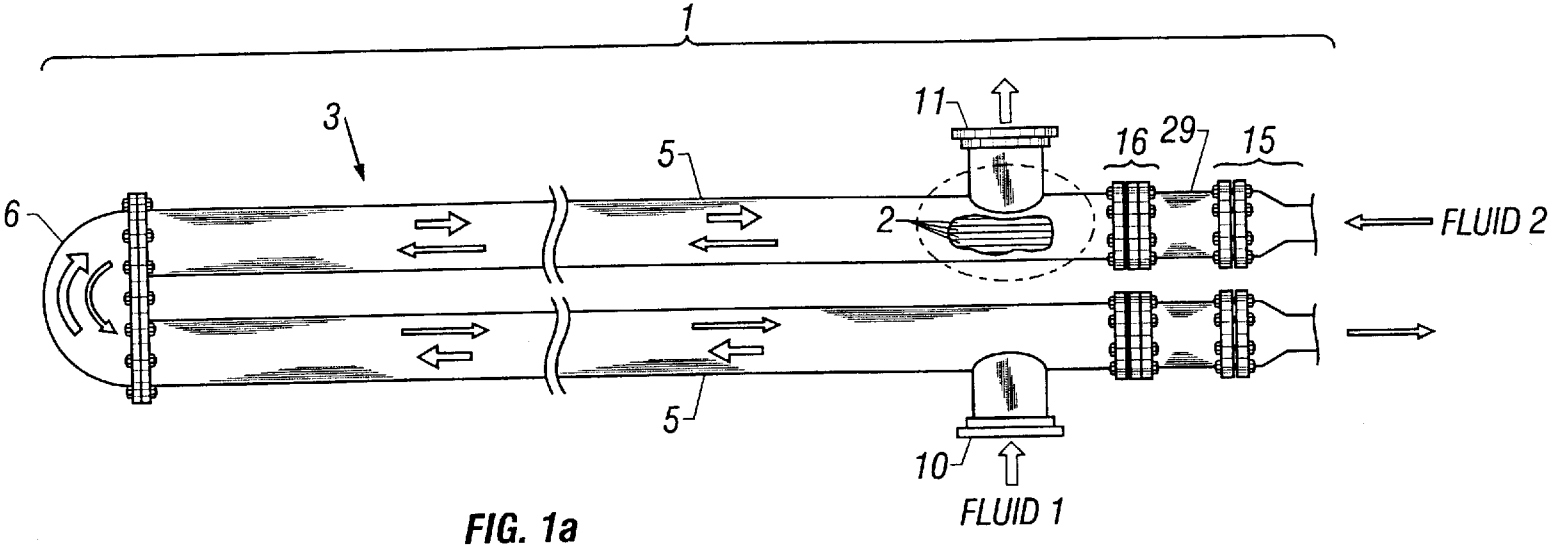
FIG. 1*a* is a plan view of a hairpin heat exchanger.
Figure 1B:
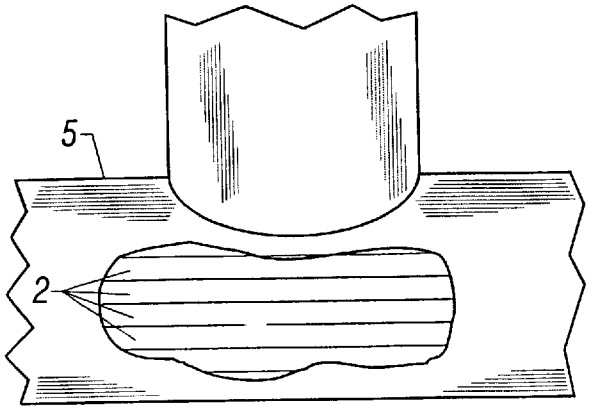
FIG. 1*b* is a view of a cut away section of the shell showing the tubes enclosed within the shell
Figure 2:
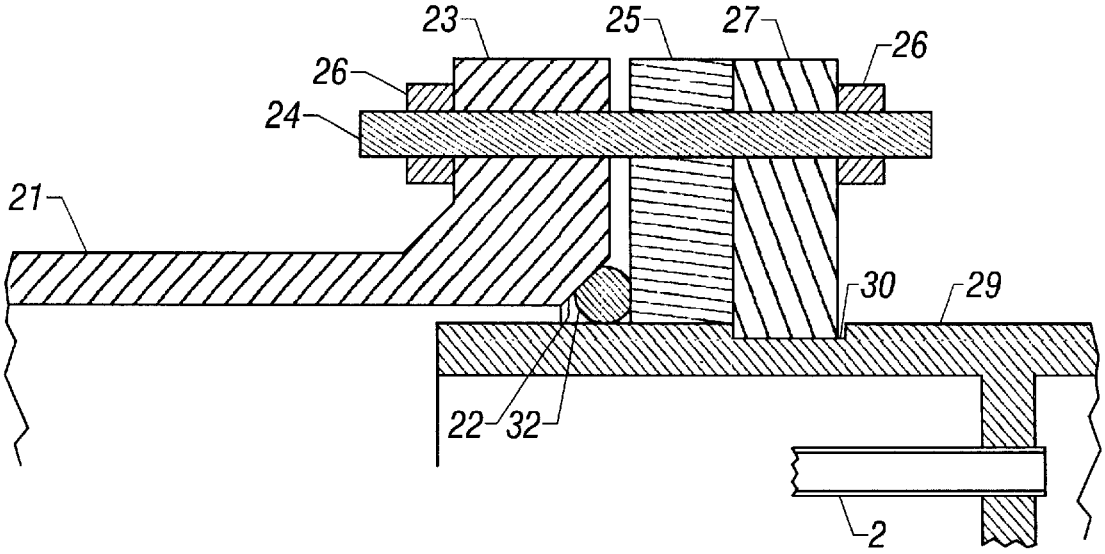
FIG. 2 (PRIOR ART)
FIG. 2 is a cross sectional view of the prior art end closure.
Figure 3A:
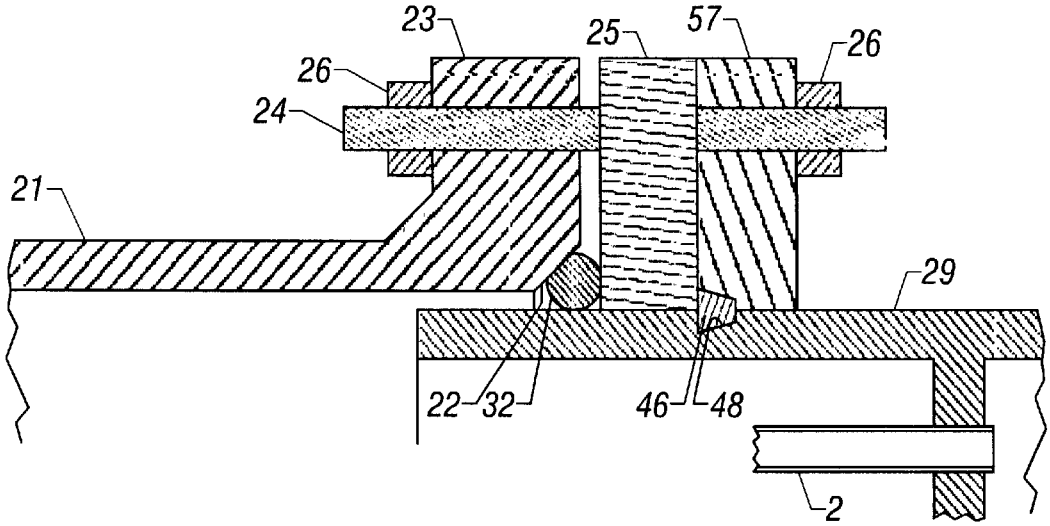
FIG. 3*a* is a cross sectional view of the preferred embodiment.
Figure 3B:
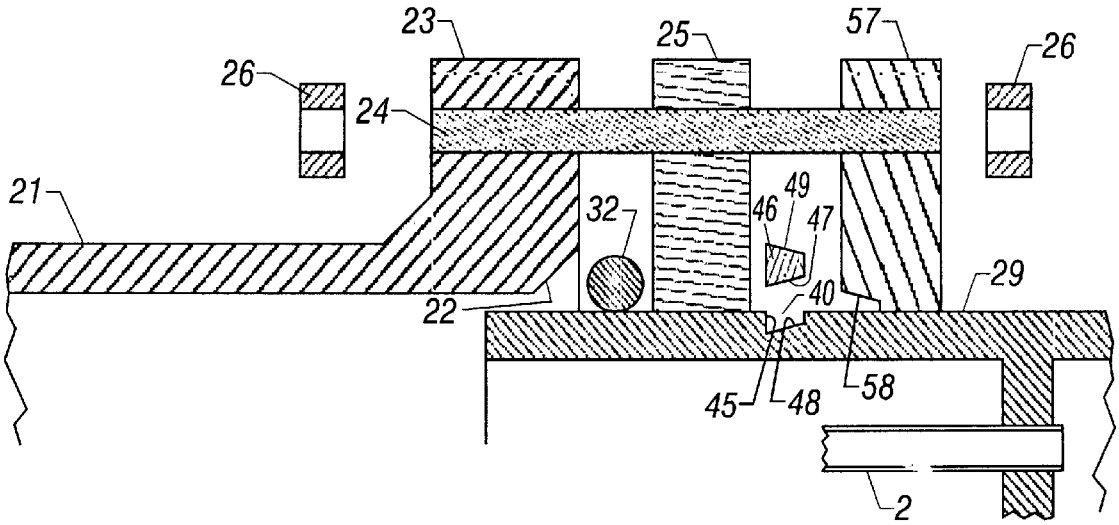
FIG. 3*b* is a partially exploded cross sectional view of the preferred embodiment.

Referring to FIGS. 3*a* and 3*b*, the preferred embodiment of the invention is shown. In the preferred embodiment, tube sheet barrel 29 is placed within the end of shell 21 and shell closure flange 23. Shell sealing ring 32 encircles tube sheet barrel 29 adjacent to shell closure flange 23. The shell sealing ring 32 is in contact with flange 23 at beveled surface 22. Compression flange 25 abuts shell sealing ring 32 opposite shell closure flange 23.

Groove 40 is generally annular, but groove surface 48, instead of being parallel to the longitudinal axis of the tube sheet barrel 29, is tapered so that it forms an annular portion of a conical surface (also referred to as a frusto-conical surface). In contrast, surface 38 in the prior art forms an annular portion of a cylindrical surface. Tapered split ring 46 has a complementary inner surface 47 which fits flush against surface 48 of groove 40. In the preferred embodiment, the outer surface 49 of split ring 46 is also angled, but in the direction opposite inner surface 47 so that the split ring has a trapezoidal cross section. Backup flange 57 has an annular recess 58 which has surfaces complementary to the surfaces of tapered split ring 46. Bolts 24 are placed through apertures in flanges 23, 25, and 57 and nuts 26 are threaded onto bolts 24 and tightened to hold the flanges together. When these components are assembled, tapered split ring 46 is forced radially inward and forward against grooved wall 45 by the force of its contact with backup flange 57. Tapered split ring 46 is thereby prevented from sliding back and forth from the front to the rear of the groove. Consequently, wear and early failures which result from such movement in prior art devices is eliminated.

Because the tapered split ring of the invention (46) is substantially smaller than the split rings of the prior art (27), it is much lighter. Instead of weighing over a hundred pounds, the tapered split ring may only weigh_pounds. Thus, instead of having to hold a dangerously heavy prior art split ring in place while attempting to assemble and bolt together the flanges, the annular backup flange 57 can simply be placed around the tube sheet barrel, where it will remain in place and the tapered split ring can be easily held while the backup flange 57 is moved forward into contact with the split ring 46. The split ring 46 is thereby held in place by the backup flange 57 while the flanges (23, 25, 57) are bolted together. The safety of the persons assembling the closure is therefore greatly enhanced.

Figure 4:
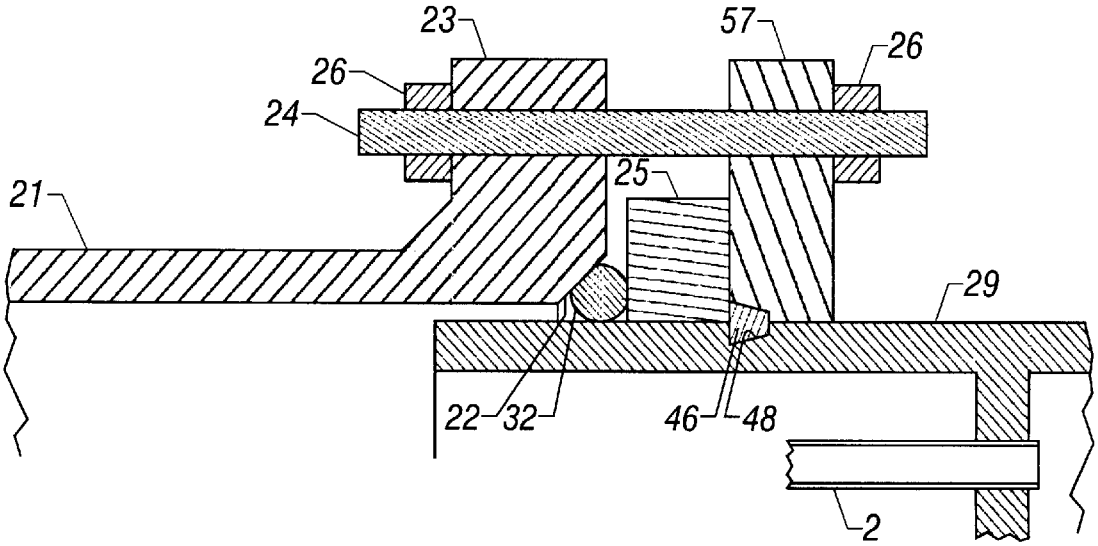
FIG. 4 is a cross sectional view of an alternate embodiment of the invention.
Figure 5:
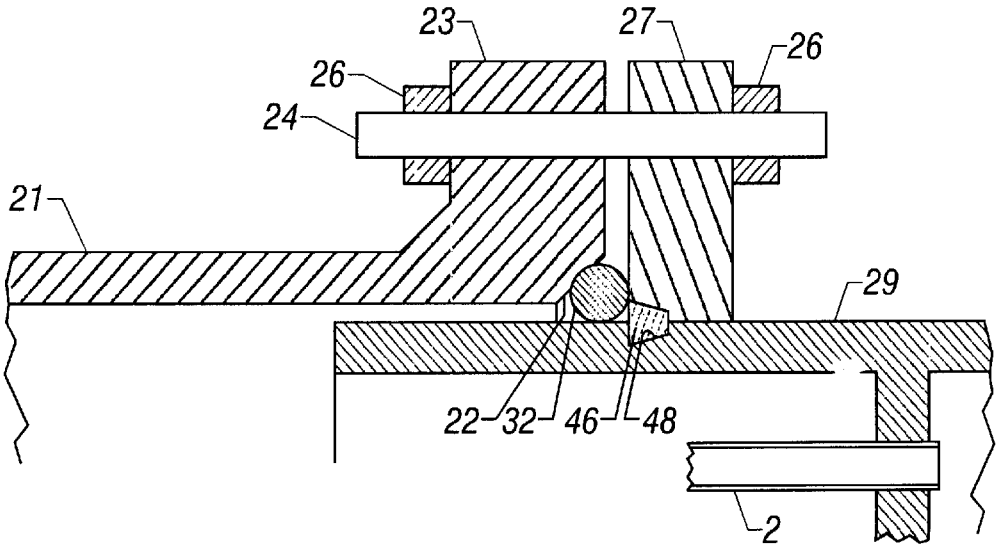
FIG. 5 is a cross sectional view of an alternate embodiment of the invention.

A number of alternate embodiments of the invention are contemplated. For example, FIG. 4 shows an embodiment which utilizes a compression flange 65 which has a reduced annular width so that bolt 24 does not extend through the compression flange. Instead, compression flange 65 is held in position between tapered split ring 46 and backup flange 57 on one side and shell sealing ring 32 and shell closure flange 23 on the other side. In fact, compression flange 65 can actually be eliminated from the inventive closure as shown in FIG. 5.

Compression flanges 25 (or 65) are necessary in prior art closures because split ring 27 can slide back and forth in groove 30 and therefore cannot apply force evenly around the circumference of shell sealing ring 32. Compression flange 25 ensures that compressive force is applied evenly to shell sealing ring 32 in the prior art closures. In the inventive closure, however, the separate halves of tapered split ring 46 simply are not allowed to move and therefore cannot apply force unevenly as do prior art split rings. Both halves of tapered split ring 46 are held against the front wall 47 of groove 40 because of the force of backup flange 57 so that compression flange 25 (or 65) can be eliminated.

The description of the foregoing embodiments is intended to be illustrative of the invention. The description is not intended to be exhaustive, nor is it intended to limit the invention to the precise embodiments described. The invention is described in such detail as to enable a person of ordinary skill in the art to practice the invention in such embodiments as are suited to the uses contemplated. All such modifications are within the scope of the invention described and claimed herein.

What is claimed is:

1. An improvement in a tube sheet barrel for use in a heat exchanger shell closure, the tube sheet barrel having a shell closure end and a tube closure end, the improvement comprising:

an annular groove formed in an external surface of the tube sheet barrel, wherein the annular groove has a first end oriented toward the shell closure end of the tube sheet barrel, a second end oriented away from the shell closure end of the tube sheet barrel, and a bottom surface, wherein the bottom surface having a tapered frusto-conical shape, and the first end diameter is less than the second end diameter; and a split ring having an inward-facing surface which is complementary to the tapered frusto-conical bottom surface of the annular groove and further having an outer diameter greater than the diameter of the tube sheet barrel;

whereby the split ring fits flush against the bottom surface of the annular groove.

2. The improvement of claim 1, further comprising a backup flange, the backup flange being generally annular in shape, the inner surface of the backup flange having a cylindrical portion which is complementary to the outer surface of the tube sheet barrel, the inner surface of the backup flange also having a recessed portion which is complementary to the outer surface of the split ring.

3. The improvement of claim 2, wherein the outer surface of the split ring is a tapered frusto-conical surface such that the outer diameter at the first end of the split ring is greater than the outer diameter at the second end of the split ring, and wherein the recessed portion of the backup flange is complementary to the outer surface of the split ring so that when the split ring is disposed in the groove of the tube sheet barrel and the backup flange is disposed so that it encircles the tube sheet barrel and the split ring, the inner surface of the backup flange is flush against the tube sheet barrel and the split ring.

4. The improvement of claim 3, further comprising a generally annular compression flange, the compression flange having an inner diameter equal to the outer diameter of the tube sheet barrel.

5. A shell closure for a heat exchanger comprising:

a shell having a closure flange at a first end of the shell;

a tube sheet barrel having a first end which is disposed within the first end of the shell;

a groove in the outer circumference of the tube sheet barrel, the groove having a constant width around the circumference of the tube sheet barrel and having a bottom surface which is frusto-conical so that the diameter of the bottom surface is smallest at a point nearest the first end of the tube sheet barrel, the groove also having a front wall nearest the first end of the tube sheet barrel;

a generally annular split ring disposed partially within the groove and having an inner surface and an outer surface, the inner surface having a taper complementary to a taper of the bottom surface of the groove so that the inner surface of the split ring is flush with the bottom surface of the groove;

a generally annular backup flange disposed around tube sheet barrel and around the split ring, the backup flange having an inner surface which has a cylindrical portion which fits flush against the tube sheet barrel and a recessed portion which has a shape complementary to the outer surface of the split ring and fits flush against the split ring;

a sealing ring disposed around tube sheet barrel between the groove and the shell closure flange;

one or more connectors which are in contact with the shell closure flange and the backup flange and which urge the shell closure flange and the backup flange toward each other, the backup flange in turn urging the split ring against the front wall of the groove, and the sealing ring being compressed against the tube sheet barrel and the shell.

6. The shell closure of claim 5, further comprising an annular compression flange disposed between the split ring and the sealing ring.

7. The shell closure of claim 5, wherein the shell closure flange and backup flange each have a plurality of holes therethrough and wherein the connectors comprise a plurality of bolts and a plurality of nuts, each of the bolts being disposed through one of the holes in the shell closure flange and one of the holes in the backup flange, each of the nuts being threaded onto one of the bolts so that the shell closure flange and backup flange are urged toward each other.

8. The shell closure of claim 7, further comprising an annular compression flange disposed around the tube sheet barrel between the split ring and the sealing ring.

9. The shell closure of claim 8 wherein the compression flange has an outer diameter which is less than the distance between a first bolt on a first side of the tube sheet barrel and a second bolt which is on the opposite side of the tube sheet barrel.

10. The shell closure of claim 8 wherein the compression flange has an outer diameter which is greater than the distance between opposite sides of a first bolt on a first side of the tube sheet barrel and a second bolt which is on the opposite side of the tube sheet barrel, the compression flange having a plurality of holes therethrough, each of the bolts being disposed through one of the holes in the compression flange.

11. The shell closure of claim 7 wherein the outer surface of the split ring is frusto-conical so that the diameter of the outer surface is greatest at a point nearest the first end of the tube sheet barrel and wherein the recessed portion of the backup flange has a frusto-conical shape complementary to the outer surface of the split ring and fits flush against the split ring.

12. The shell closure of claim 5 wherein the outer surface of the split ring is frusto-conical so that the diameter of the outer surface is greatest at a point nearest the first end of the tube sheet barrel and wherein the recessed portion of the backup flange has a frusto-conical shape complementary to the outer surface of the split ring and fits flush against the split ring.

13. The shell closure of claim 12 wherein the angle between the inner surface of the split ring and the axis of the tube sheet barrel is equal to the angle between the outer surface of the split ring and the axis of the tube sheet barrel.

14. A method of sealing a tube sheet barrel against a shell comprising the steps of:

providing a shell having a closure flange at a first end of the shell;

providing a tube sheet barrel having a first end facing the shell, the tube sheet barrel further having a circumferential groove in its outer surface, the groove having a frusto-conical bottom surface which has a smaller diameter at the side of the groove nearest the first end of the tube sheet barrel, the groove also having a front surface which is adjacent to the side of the bottom surface which is nearest the first end of the tube sheet barrel;

placing a generally annular backup flange having an inner surface with a cylindrical portion and a recessed portion around the tube sheet barrel so that the backup flange is disposed on the side of the groove opposite the first end of the tube sheet barrel;

placing a sealing ring around the tube sheet barrel between the first end of the tube sheet barrel and the groove;

placing the first end of the tube sheet barrel within the first end of the shell;

placing a split ring which has an inner surface complementary to the frusto-conical bottom surface of the groove and an outer surface complementary to the recessed portion of the backup flange flush against the bottom surface of the groove;

moving the backup flange toward the first end of the tube sheet barrel until the backup flange is disposed radially outward from the split ring so that the split ring is retained in the groove by the backup flange;

connecting the backup flange and shell closure flange so that they are urged toward each other and the seal is compressed against the shell closure flange and the tube sheet barrel.

15. The method of claim 14, further comprising the step of placing an annular compression flange around the tube sheet barrel between the sealing ring and the groove.

16. The method of claim 14 wherein the step of connecting the backup flange and shell closure flange is accomplished by placing bolts through holes in the backup flange and shell closure flange, threading nuts onto the bolts and tightening the nuts to urge the backup flange and shell closure flange together.

17. An improved shell closure for a heat exchanger, comprising:

a shell closure having a closure flange at a first end of the shell;

a tube sheet barrel having a first end which is disposed within the first end of the shell;

a groove in the outer circumference of the tube sheet barrel, said groove having a bottom surface which is frusto-conical so that the diameter of the tube sheet barrel is smallest at a point nearest the first end of the tube sheet barrel, said groove also having a front wall nearest the first end of the tube sheet barrel;

a generally annular split ring disposed partially within the groove and having an inner surface and an outer surface, the inner surface having a taper complementary to a taper of the bottom surface of the groove so that the inner surface of the split ring is flush with the bottom surface of the groove;

a generally annular backup flange disposed around tube sheet barrel and around the split ring, the backup flange having an inner surface which has a cylindrical portion which fits flush against the tube sheet barrel and a recessed portion which has a taper shape complementary to the outer taper surface of the split ring and fits flush against the split ring;

a sealing ring disposed around tube sheet barrel between the groove and the shell closure flange; and one or more connectors which are in contact with the shell closure flange and the backup flange and which urge the shell closure flange and the backup flange toward each other, the backup flange in turn urging the split ring against the front wall of the groove, and the scaling ring being compressed against the tube sheet barrel and the shell, wherein the outer surface of the split ring is frusto-conical so that the diameter of the outer surface is greatest at a point nearest the first end of the tube sheet barrel, the recessed portion of the backup flange has a frusto-conical shape complimentary to the outer surface of the split right and fits flush against the split ring, and the angle between the inner surface of the split ring and the axis of the tube sheet barrel is equal to or greater than the angle between the outer surface of the split ring and the axis of the tube sheet barrel.

18. The improved shell closure for a heat exchanger of claim 17, further comprising an annular compression flange disposed between the split ring and the sealing ring.

19. The improved shell closure for a heat exchanger of claim 17, further comprising an annular compression flange disposed between the tube sheet barrel between the split ring and the sealing ring.

20. The improved shell closure for a heat exchange of claim 19 wherein the compression flange has an outer diameter which is less than the distance between a first bolt on a first side of the tube sheet barrel and a second bolt which is on the opposite side of the tube sheet barrel.

21. The improved shell closure for a heat exchange of claim 19 wherein the compression flange has an outer diameter which is greater than the distance between opposite sides of a first bolt on a first side of the tube sheet barrel and a second bolt which is on the opposite side of the tube sheet barrel, the compression flange having a plurality of holes therethrough, each of the bolts being disposed through one of the holes in the compression flange.

22. The improved shell closure for a heat exchanger of claim 17, wherein the shell closure flange and the backup flange each have a plurality of holes therethrough, and the connectors comprise a plurality of bolts and a plurality of nuts, each of the bolts being disposed through one of the holes in the shell closure flange and one of the holes in the backup flange, each of the nuts being threaded onto one of the bolts whereby the shell closure flange and the backup flange are urged toward each other.

* * * * *